US005636180A

United States Patent [19]

Grothaus et al.

[11] Patent Number: 5,636,180

[45] Date of Patent: Jun. 3, 1997

[54] SYSTEM FOR PREVENTING BIOFOULING OF SURFACES EXPOSED TO WATER

[75] Inventors: Michael G. Grothaus, Boerne, Tex.; Michael S. Mazzola, Mississippi State, Miss.; Marianne Walch, Laural, Md.

[73] Assignee: The United States of America as represented by the Secretary of the Navy, Washington, D.C.

[21] Appl. No.: 515,879

[22] Filed: Aug. 16, 1995

[51] Int. Cl.[6] ..... G10K 15/06

[52] U.S. Cl. ..... 367/147; 367/139

[58] Field of Search ..... 367/139, 147; 116/22 A

[56] References Cited

U.S. PATENT DOCUMENTS

| | | | |
|---|---|---|---|
| 3,486,062 | 12/1969 | Schrom | 367/147 |
| 4,092,858 | 6/1978 | Edgerton | 73/170 A |
| 4,375,991 | 3/1983 | Sachs et al. | 134/1 |
| 5,208,788 | 5/1993 | Dancer et al. | 367/147 |
| 5,245,988 | 9/1993 | Einars et al. | 367/147 |
| 5,397,961 | 3/1995 | Ayers et al. | 315/111.21 |
| 5,432,756 | 7/1995 | Bryden | 367/139 |

OTHER PUBLICATIONS

Taylor et al. "Ultrasonics as an alternative to Chlorine for inhibiting Biofouling", Johns Hopkins APL Tech. Dig. (USA), vol. 3, No. 3, pp. 295–297. Jul 1982.

*Primary Examiner*—Ian J. Lobo

*Attorney, Agent, or Firm*—John L. Forrest; Jacob Shuster

[57] ABSTRACT

Acoustical shock waves are generated by electrical sparks within a gap between electrodes adjustably positioned for exposure to water adjacent a surface immersed therein. High voltage electrical energy derived from a constant current power supply, is stored in a capacitor for rapid. application to the electrodes by discharge during cyclic periods of short duration under remote control in order to render the acoustical shock waves so generated effective in preventing biofouling of the surface by organisms in the water.

7 Claims, 2 Drawing Sheets

SYSTEM FOR PREVENTING BIOFOULING OF SURFACES EXPOSED TO WATER

BACKGROUND OF THE INVENTION

The present invention relates in general to an electrical method and apparatus for preventing biofouling buildup on surfaces exposed to fresh water or saltwater.

The growth and accumulation of biological organisms and the by-products resulting therefrom on surfaces of structures and machinery in contact with either fresh water or salt water, represents a constant maintenance problem for such structures and machinery. For example, the hull of ships and associated seawater exposed systems become coated with both microfouling and macrofouling material such as water-borne algae, bacterial-induced biofilm, barnacles, mussels, etc., which may additionally enhance or induce corrosion.

In order to deal with the foregoing problem, a considerable amount of research activity has been undertaken in an effort to find solutions that are both economical and environmentally compatible, involving various non-chemical treatment technologies including sonics. Biofouling control by use of sonics under study for some time, is now well known and includes the use of conventional ultrasonic sources found to have mixed results for a variety of reasons, including for example a low cavitation threshold at ultrasonic frequencies associated with the use of prior biofouling treating techniques. The use of electric fields and currents in biofouling control applications are also known, but has met with varied results which are furthermore difficult to duplicate.

In connection with the foregoing referred to technologies, U.S. Pat. Nos. 3,486,062, 5,208,788 and 5,245,988 to Schrom, Dancer et al. and Einars et al., respectively, may be of interest. The Schrom patent relates to the generation of shock waves by electric spark discharge from an electrode in a surrounding liquid medium, such shock waves being directed and focused for various types of manufacturing and process operations. The Dancer et al. patent relates to circuitry for triggering sparks within gaps between electrodes for purpose of electrode position detection and correction. As to the Einars et al. patent, it relates to the production of shock waves by electrical discharge of capacitor stored energy between electrodes immersed in liquid for treatment of living tissue. However, none of the foregoing Schrom, Dancer et al. and Einars et al. patents relates to biofouling prevention, treatment or control.

Accordingly, it is an important object of the present invention to generate pulsed acoustic shock waves for continuous biofouling control purposes within a body of liquid water, with greater efficiency in the delivery of acoustic power and having a higher cavitation threshold to enlarge the water treatment region with reduced collateral damage.

SUMMARY OF THE INVENTION

In accordance with the present invention, acoustical shock waves are cyclically produced by high voltage pulses from a storage capacitor across a spark gap between bail-shaped, electrodes adjustably positioned for exposure to water adjacent to a surface immersed therein. Such high voltage pulses, stored within the capacitor during short charging cycles of less than 1 microsecond, are rapidly applied to the electrodes by capacitor discharge through a stray inductance in series with a peaking spark gap device to prevent conduction of current to the electrodes between capacitor charging cycles. Electrical energy for charging of the storage capacitor during such charging cycles is derived from a constant current power supply that is protected against voltage reversals by a resistor through which the power supply is connected to the storage capacitor. The power supply is also disabled during cyclic periods of capacitor discharge to the electrodes of short duration, under control of circuitry which also controls capacitor charging voltage and charging time. The resulting acoustical shock waves generated at the electrodes, interact with biofouling organisms to prevent attachment thereof to the water immersed surface being protected.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
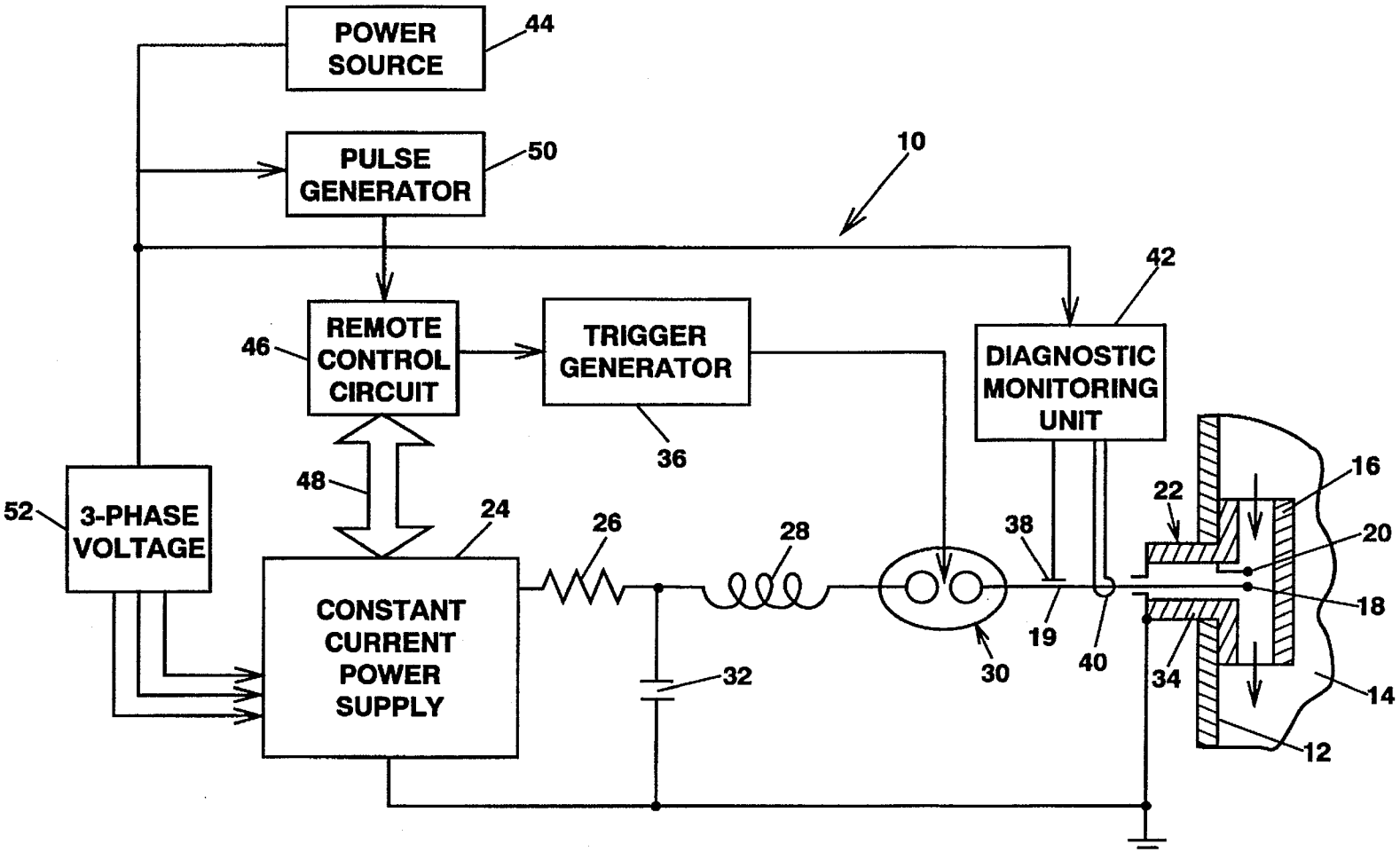
FIG. 1 is a circuit diagram of a biofouling treatment system in accordance with one embodiment of the invention.

Referring now to the drawing in detail, FIG. 1 diagrams a system 10 for preventing biofouling build-up on a wall surface 12 immersed within liquid 14, such as fresh water or seawater. The liquid in contact with surface 12 is conducted through a pipe section 16 mounted in abutment with surface 12 for exposure of such liquid to pulsed acoustic energy produced by electric sparks in a gap between high voltage electrodes 18 and 20 of an acoustic pulse source generally referred to by reference numeral 22. At the instant that each spark occurs between electrodes 18 and 20, a steep compression shock wave is generated which interacts with any bio-matter suspended in the body of liquid 14 within the region adjacent to surface 12 in order to prevent attachment thereof to surface 12. Such bio-matter includes a variety of organisms. As a result, a significant reduction in the rate of biofouling of an underwater surface by both micro and macro organisms has been achieved in accordance with the present invention.

With continued reference to FIG. 1, the electrode 18 is connected by power line 19 to a constant current power supply 24 through a resistor 26 in series with an inductance 28 and a spark gap peaking type of switch device 30. A storage capacitor 32 is connected between the power supply and its ground line electrically grounding the electrode 20 through the housing 34 of the acoustic pulse source 22. Upon closure of the spark gap peaking device 30, under control of a trigger generator 36, a high voltage is applied by power supply 24 across the electrodes 18 and 20 through stray inductance 28 and resistor 26 in series therewith. The resistor 26 protects the power supply from voltage reversals without dissipation of any significant amount of power, in view of the constant current nature of the power supply 24. The voltage and current supplied by discharge of capacitor 32 to the electrode 18 of the acoustic pulse source 22, are respectively monitored through voltage and current sensors 38 and 40 connected to a diagnostic monitoring unit 42.

Electrical energy for operation of the monitoring unit 42, the power supply 24 and the trigger generator 36 is derived from a suitable power source 44 as diagrammed in FIG. 1. The power supply 24 is of a commercially available type capable of being externally controlled by a remote control circuit 46 through a 15-pin interface 48, for example, so as to implement high voltage cyclic charge of storage capacitor 32 through resistor 26. At the end of each charge cycle, the high voltage power supply 24 is disabled under control of the remote control circuit 46 to isolate the power supply and deliver a signal to trigger generator 36 so as to provide rapid, low energy output pulses causing rapid closure of the aforementioned spark gap peaking device 30. Rapid application of the high voltage stored in capacitor 32 to the acoustic pulse source 22 through inductance 28, is thereby achieved. The operating characteristics of the spark gap device 30 may be varied by adjustment of its gap spacing and gas operating pressure, as generally known in the art, to meet desired voltage and current conditions. The voltage and current applied to acoustic pulse source 22 from capacitor 32 are therefore monitored through the aforementioned diagnostic unit 42. The pulse width of a high voltage pulse of relatively short duration is formed when the switch device 30 discharges capacitor 32 resulting in a discharge current to the electrodes conducted through cable 19 having a rise time of less than one (1) microsecond corresponding to the charging time of capacitor 32 which is controlled by pulse generator 50. Such charging voltage applied to capacitor 32 under control of pulse generator 50 ranges from 12 to 15 kV, derived from the constant current power supply 24 to which a 208 volt, 3-phase prime power input 52 is fed, as denoted in FIG. 1. Acoustic waves having a relatively high cavitation threshold is thereby generated at source 22 in accordance with the present invention.

Figure 2:
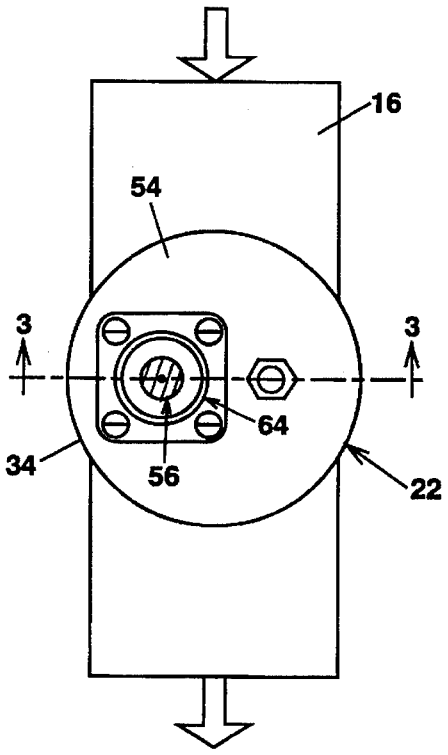
FIG. 2 is a top plan view of an acoustic pulse source component of the system depicted in FIG. 1.
Figure 3:
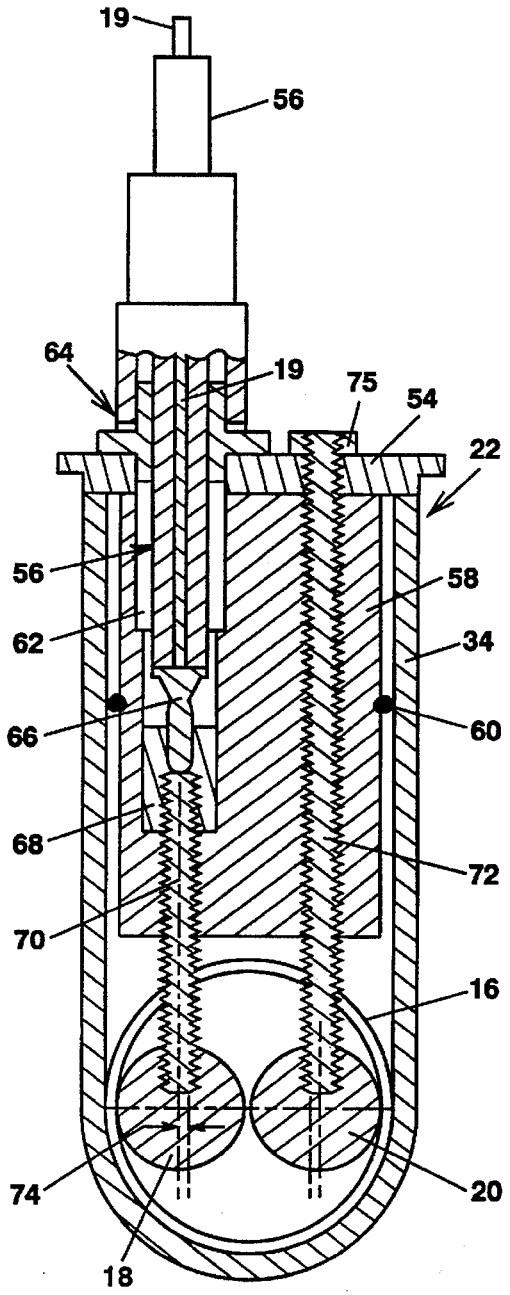
FIG. 3 is a side section view taken substantially through a plane indicated by section line 3—3 in FIG. 2.

Referring now to FIGS. 2 and 3 in particular, the electrode geometry of the acoustic pulse source 22 is shown enclosed within the housing 34 extending perpendicular from its intersection with the pipe section 16 at which the electrodes 18 and 20 are located. A base plate 54 connected to housing 34 closes its axial end into which the power line 19 extends within a cable., 56. An insulator body 58 is enclosed within the housing 34 in abutment with the base plate 54, seating an O-ring 60 in engagement with the housing 34 to form a water-tight seal. The cable 56 extends into a stepped bore 62 formed in the insulator body 58 in alignment with a base plate opening closed by a demountable connector 64 removably anchoring the cable 56 in its illustrated position within the insulator body 58. The end of the power line 19 within the housing 34 is electrically connected by contact terminal 66 to a conductive adapter plug 68 made of brass, for example. The plug 68 seated in the insulator opening 62 at its lower end, has a threaded bore receiving one end portion of a threaded support rod 70 made of stainless steel. The other end portion of rod 70 below the insulator body 58, is threadedly connected to the electrode 18 which is in the form of a stainless steel ball bearing, as shown in FIG. 3.

The other electrode 20 is similar in construction and mounting support to that of electrode 18, as also shown in FIG. 3. Thus, a threaded support rod 72 positions the electrode 20 in spaced adjacency to electrode 18. Such mounting of the ball-shaped electrodes 18 and 20 may be somewhat offset from the axes of rods 70 and 72, as indicated by reference number 74, so that spark gap spacing adjustment may be made by either rotating the electrodes on the rods 70 and 72 or replacing them with electrodes having different ball diameters centered relative to the internal diameter of the pipe section 16. Also, the rod 72 threadedly extends completely through the insulator body 58 between its axial ends, parallel to rod 70. The upper end of rod 72 furthermore extends through the base plate 54 to which it is anchored by nut 75 and through which the electrode 20 is grounded by connection to the ground line as aforementioned.

From the foregoing description it will be apparent that the pulses generated between the electrodes 18 and 20 of the acoustic pulse source 22 are formed when the spark gap switch 30 causes the capacitor 32 to discharge into the cable 19 to the electrode 18. The rise time of the resulting current between electrodes 18 and 20 should be less than 1 microsecond as aforementioned corresponding to the limited discharge time of the capacitor 32. By use of the foregoing described acoustic source 22, non-chemical treatment to prevent biofouling is achieved both upstream and downstream of its location within an otherwise untreated body of water. Obviously, other modifications and variations of the present invention may be possible in light of the foregoing teachings. It is therefore to be understood that within the scope of the appended claims the invention may be practiced otherwise than as specifically described.

What is claimed is:

1. A method of treating a body of liquid within a region in contact with a surface immersed in said liquid, by means of acoustical energy, including generation of the acoustical energy by electrical discharge through a spark gap established within said region, the improvement residing in conducting constant electrical current during charging cycles for cyclic storage of the acoustical energy; preventing conduction of the current to the spark gap during said charging cycles; and limiting said electrical discharge to cyclic periods of short duration of less than a predetermined time to prevent biofouling of the surface.

2. Apparatus for treating a body of liquid adjacent to a surface immersed therein to prevent biofouling of said surface, including: a storage capacitor; an acoustic pulse source operatively connected to the storage capacitor; and means mounting the acoustic pulse source on said surface for cyclic emission of shock waves within the body of liquid in response to discharge of electrical energy from the storage capacitor, the improvement residing in: means operatively connected to the storage capacitor for supplying constant current thereto; and means for controlling storage of the electrical energy by the storage capacitor in response to said supplying of the constant current thereto for limiting said discharge therefrom resulting in current conducted through the acoustic pulse source having a rise time of less than one (1) microsecond.

3. The apparatus as defined in claim 2 wherein the means mounting the acoustic pulse source comprises: a pipe section in abutment with the surface through which the liquid is conducted; a housing extending from the pipe section through said surface in enclosing relation to the electrodes; conductive support means connected to the electrodes for electrical connection thereof to the storage capacitor; and insulator means within the housing through which the conductive support means extends for positioning the electrodes in spaced relation to each other while exposed to the liquid within the pipe section.

4. The apparatus as defined in claim 3 wherein said electrodes are ball shaped.

5. In a system for treating a body of water adjacent to a surface with acoustical shock waves preventing biofouling of the surface, a power supply from which voltage pulses are derived and means for generating said acoustical shock waves comprising: a pair of electrodes; a pipe section through which the water is conducted; a housing connected to the pipe section enclosing the electrodes therein; support rods connected to the electrodes; insulator means through which the support rods extend within the housing for positioning the electrodes in spaced relation to each other establishing a spark gap; and means operatively connecting the support rods to the power supply for applying said voltage pulses across the spark gap between the electrodes during cyclic periods of short duration to produce said acoustical shock waves within the body of water.

6. The system as defined in claim 5 wherein the means operatively connecting the support rods to the power supply includes: a storage capacitor from which discharge occurs limited to current between the electrodes having a rise time of less than one (1) microsecond corresponding to said cyclic periods of short duration and means limiting charging of the storage capacitor by constant current from the power supply between said cyclic periods of discharge.

7. Apparatus for generating an acoustical shock wave in a liquid medium which comprises:

(a) first and second spaced electrodes contacting the liquid medium, (b) positioning means for maintaining spacing between the first and second electrodes in contact with the medium adjacent to a surface subject to biofouling;

(c) a pulse-forming network coupled between a power supply and the first and second electrodes for initiating a spark discharge current therebetween; and (d) output switch means connected between the pulse-forming network and at least one of the electrodes for transmitting a pulse of energy to said electrodes whereby the shock wave is generated in said medium, said pulse-forming network including: at least one storage capacitor within which the pulse energy is stored in response to constant current received from the power supply; and means for limiting said spark discharge current to a rise time of less than one (1) microsecond corresponding to short duration discharge of the pulse energy from the storage capacitor.

* * * * *